US008904608B2

(12) United States Patent
Kaulitzki

(10) Patent No.: US 8,904,608 B2
(45) Date of Patent: Dec. 9, 2014

(54) GODET UNIT

(75) Inventor: Marco Kaulitzki, Nortorf (DE)

(73) Assignee: Oerlikon Textile GmbH & Co., KG, Remscheid (DE)

( * ) Notice: Subject to any disclaimer, the term of this patent is extended or adjusted under 35 U.S.C. 154(b) by 400 days.

(21) Appl. No.: 13/313,694

(22) Filed: Dec. 7, 2011

(65) Prior Publication Data

US 2012/0144633 A1 Jun. 14, 2012

(30) Foreign Application Priority Data

Dec. 13, 2010 (DE) ..... 10 2010 054 326

(51) Int. Cl.

| | |
|---|---|
| ***D02J 1/08*** | (2006.01) |
| ***D02G 1/16*** | (2006.01) |
| ***D02J 1/06*** | (2006.01) |
| ***D02J 1/22*** | (2006.01) |
| ***D02J 13/00*** | (2006.01) |

(52) U.S. Cl.

CPC ..... *D02G 1/161* (2013.01); *D02G 1/162* (2013.01); *D02J 1/06* (2013.01); *D02J 1/08* (2013.01); *D02J 1/22* (2013.01); *D02J 13/005* (2013.01)

USPC ..... 28/271; 28/220; 28/240; 28/247

(58) Field of Classification Search

USPC ..... 28/247, 252, 271, 253, 219, 220, 240, 28/246, 257, 258, 272, 274, 276, 283, 221, 28/250, 254, 256, 243, 245; 57/350, 908, 57/333, 287, 310; 264/168, 289.6, 290.7

See application file for complete search history.

(56) References Cited

U.S. PATENT DOCUMENTS

| | | | | | |
|---|---|---|---|---|---|
| 2,708,843 | A | * | 5/1955 | Gibson et al. | 68/5 E |
| 2,874,445 | A | * | 2/1959 | Griset, Jr. | 28/248 |
| 2,985,995 | A | * | 5/1961 | Bunting, Jr. et al. | 57/204 |
| 3,217,386 | A | * | 11/1965 | Clendening, Jr. | 68/3 R |
| 3,431,716 | A | * | 3/1969 | Mertens | 57/290 |
| 3,949,041 | A | * | 4/1976 | Schwarz | 264/168 |
| 5,134,840 | A | * | 8/1992 | Niederer et al. | 57/204 |
| 5,390,400 | A | * | 2/1995 | Jacob et al. | 28/274 |
| 6,120,715 | A | * | 9/2000 | Weigend | 264/103 |
| 7,226,286 | B2 | * | 6/2007 | Schroter | 432/59 |
| 2008/0083103 | A1 | * | 4/2008 | Germer | 28/221 |

FOREIGN PATENT DOCUMENTS

| | | | | |
|---|---|---|---|---|
| DE | 4140469 | A1 | | 12/1991 |
| DE | 19958245 | A1 | | 12/1999 |
| EP | 633334 | A1 | * | 1/1995 |
| WO | WO 2006/058667 | A1 | * | 6/2006 |

* cited by examiner

*Primary Examiner* — Amy Vanatta

(74) *Attorney, Agent, or Firm* — BainwoodHuang

(57) ABSTRACT

Techniques are directed to godet unit for guiding a multifilament thread, including a driven godet of an auxiliary roller or a second godet, from which the thread can be guided with multiple loopings, and including a mingling device for air-mingling the thread. The godet and the mingling device are provided in the form of a combined assembly.

13 Claims, 4 Drawing Sheets

GODET UNIT

CROSS-REFERENCE TO RELATED APPLICATIONS

This Patent Application claims priority to German Patent Application No. 10 2010 054 326.8 filed on Dec. 13, 2010, entitled, "GALETTENEINHEIT", the contents and teachings of which are hereby incorporated by reference in their entirety.

FIELD OF THE INVENTION

The invention relates to a godet unit for guiding a multifilament thread, having a driven godet, an auxiliary roller, or a second godet, from which the thread can be guided with multiple loopings, and including a mingling device to air-mingle the thread.

BACKGROUND

A godet unit of the generic kind has been disclosed in WO 2006/058667 A1.

The known godet unit includes a godet and an auxiliary roller associated with the godet to guide a thread with multiple loopings. A mingling device is disposed between the godet and the auxiliary roller. A thread segment tensioned between the godet and the auxiliary roller is associated with the mingling device so as to generate mingling along the moving thread. During mingling, which is also known by the term tangling, a stream of compressed air is directed at the thread such that a tangling of the individual filaments results, thereby producing thread compaction along the thread. Here more or less distinct mingling knots are formed as a function of the intensity of the compressed air, which knots at regular intervals generate the thread compaction of the thread for further processing. What is desired here is a minimum knot count per unit of length of the thread in order to prevent the filament bundle from spreading out during subsequent processing. A high level of uniformity and a relatively high number of interlacing knots per quantity of thread is desirable in particular in the case of threads that are being supplied for final processing, such as, for example, carpet yarns.

SUMMARY

A station mingling device is used in the known device, in which the thread after leaving the godet is guided through a treatment channel of the mingling device in which a nozzle orifice with a stream of air terminates. Stationary devices of this type have the disadvantage that gaps without interlacing knots, or an insufficient number of interlacing knots, can be generated in the thread at high thread speeds. In addition, a mingling device integrated in a godet unit, which device is typically disposed between a godet and an auxiliary roller or between two godets, impedes the run of the thread for adjacent thread loopings. As a result, minimum distances must be maintained between the thread loopings in the godet unit so as not to impede the air for adjacent thread runs that exit from the mingling device.

The object of this invention is therefore to design the godet unit of the generic kind for guiding a multifilament thread in such a way that adjacent loopings of the thread are not impaired on the godet unit, even in the case of relatively close thread distances from the mingling device.

Another object of the invention is to provide a godet unit including a mingling device that can generate a sufficient number of interlacing knots even at thread speeds above 3,000 m/min.

This object is achieved according to the invention for a godet unit by an approach wherein the mingling device is associated directly with the godet and forms a combined assembly with the godet.

The invention is distinguished by the fact that the intermediate space between the godet and the auxiliary roller can be freely exploited to guide the thread. The mingling device is integrated directly in the godet, with the result that the thread undergoes an air treatment by the mingling unit when wound onto or unwound from the godet.

In an advantageous development of the invention, the combined assembly created in this way preferably includes a rotatingly driven guide jacket including multiple axially successive guide sections, wherein a circumferential guide groove including at least one nozzle orifice penetrating the guide jacket is provided on one of the guide sections of the guide jacket, and wherein a compressed-air supply device is associated with the guide section inside the guide jacket. As a result, the thread can be advantageously guided in multiple loopings around the guide jacket of the combined assembly. In one of the guide sections, the thread is guided in the guide groove in which an air treatment of the thread can be implemented at an angled position of the guide jacket in order to generate interlacing knots.

Depending on the process parameters and the thread type, the guide section can be designed with a guide groove, in an advantageous variant of the godet unit according to the invention, the guide groove being provided at an edge zone of the guide jacket or in a central region of the guide jacket.

The godet unit is preferably implemented in such a way that the guide section with the guide groove is provided on a diameter stage of the guide jacket so as to enable a thread tension to be adjusted independently of the position in the guide groove on the guide jacket, which tension is optimal for mingling between the thread loopings. The guide section of the guide jacket adjacent to the guide groove can be provided in identical or unidentical size in terms of diameter to the diameter stage, depending on the requirement as to whether the desired goal is to increase the thread tension or to decrease the thread tension. This thus provides a high degree of flexibility both in terms of the guidance and also in the mingling of the thread. In particular, this also allows differences in speed to be effected between the circumferential speed of the guide groove and the thread, thereby obtaining additional parameters for generating the most stable possible interlacing knots.

The guide sections of the guide jacket here can be of either cylindrical or conical form.

In order to be able to implement the thread guidance and thread mingling independently of each other on the combined assembly, the combined assembly in another advantageous development of the invention is designed so that the combined assembly includes a rotatingly driven guide jacket and a rotating nozzle ring associated with the guide jacket, which nozzle ring has around its circumference a circumferential guide groove and at least one nozzle orifice terminating in the guide groove, wherein the nozzle ring functions together with a compressed-air supply device disposed inside the nozzle ring. The nozzle ring here is disposed coaxially relative to the guide jacket, where the nozzle ring can take up either the incoming thread or also the outgoing thread. In principle, it is also possible here to drive the guide jacket of the combined assembly and the nozzle ring independently of each other. The guide jacket can thus be provided in the form of a heated godet or unheated godet.

The preferred embodiment of the godet unit, however, is one in which the guide jacket and the nozzle ring of the combined assembly are connected to a drive shaft and designed to be driven synchronously by an electric drive means (or electric driver). The nozzle ring and the guide jacket here can have diameters of identical or unidentical size, thereby also enabling the thread tension or a relative speed to be adjusted between the threads and the guide groove of the nozzle ring.

Regardless of whether the combined assembly is composed of a guide jacket, or of a guide jacket and a separate nozzle ring, the compressed-air supply device can preferably be implemented by a stator with a pressure chamber and a chamber orifice, which stator together with the chamber orifice is disposed on an interior side of the guide jacket or on an interior side of the nozzle ring opposite the guide groove. The stator is stationary, and together with its chamber orifice is preferably disposed in a central region of a contact area between thread and guide groove, which area is formed by the partial looping of the thread.

In an advantageous development of the invention, the stator is provided with a sliding surface so as to make possible the transition from the stationary stator to the nozzle orifice formed in the guide groove without significant drops in pressure, in which surface the chamber orifice terminates and which forms a sealing gap against the inside of the guide jacket or against the inside of the nozzle ring. This enables the stator to be optimally matched to the inner contour of the guide jacket or to an inner contour of the nozzle ring.

In an advantageous development, the godet unit is implemented especially advantageously and so as to ensure the uniformity of the generated interlacing knots, whereby a stationary cover is associated with the guide groove on an exterior side opposite the stator, which cover extends radially over a partial region of the guide groove. As a result, the thread is guided within a covered guide groove during the mingling process.

The cover has a sealing surface matched to the circumference of the guide groove so as to also prevent as far as possible any increased air losses to the environment, this surface being disposed with a gap above the guide section or the nozzle ring. As a result, the compressed air is essentially diverted away through the guide groove at both sides of the cover.

In the event the guide jacket of the combined assembly has multiple guide sections, where at least one of the guide sections includes a guide groove of at least one nozzle orifice in the groove base, a godet designed in this way can be advantageously used directly. As a result, a godet according to the invention including a rotatingly driven guide jacket is used especially preferably in this type of godet unit. The guide sections of the guide jackets that are provided adjacent to the guide section with the circumferential guide groove can alternatively also be heated.

The godet unit according to the invention is particularly well-suited for guiding and mingling the threads in melt-spinning processes in which multifilament threads are generated. In principle, it is also possible to guide multiple threads in the guide jacket in a parallel adjacent fashion. In this case, a separate guide groove would be associated with each of the threads.

BRIEF DESCRIPTION OF THE DRAWINGS

The following discussion describes the godet unit according to the invention in more detail based on several example embodiments, with reference to the attached figures.

Here.

DETAILED DESCRIPTION

Figure 1:
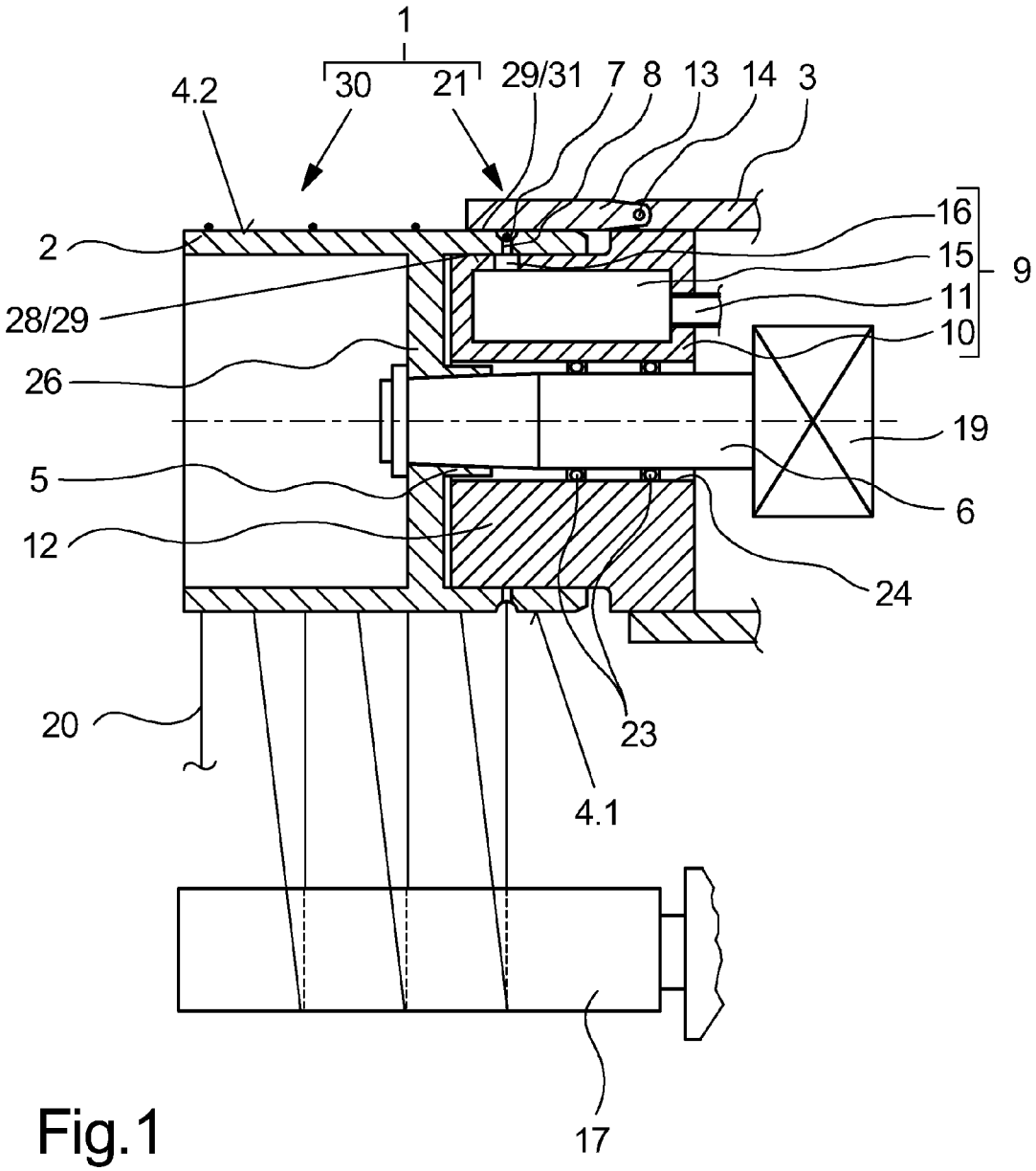
FIG. 1 is a schematic longitudinal view of a first embodiment of the godet unit according to the invention.
Figure 2:
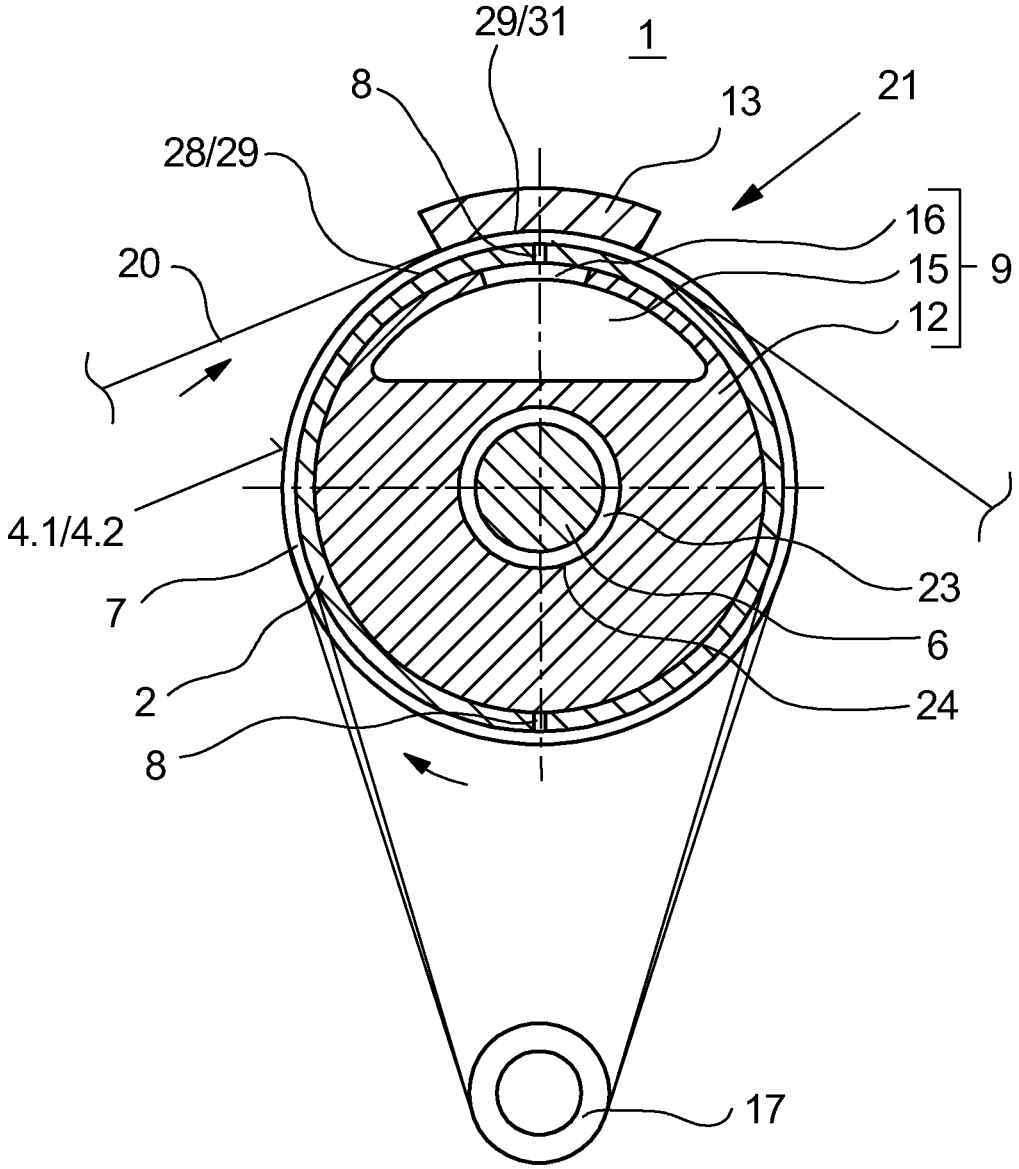
FIG. 2 is a schematic cross-sectional view of the embodiment of FIG. 1.

FIGS. 1 and 2 provide multiple views of a first embodiment of the godet unit according to the invention. FIG. 1 provides a longitudinal view and FIG. 2 provides a cross-sectional view of the embodiment, a combined assembly. The following description applies to both figures insofar as no explicit reference is made to one of the figures.

The embodiment of a godet unit according to the invention for guiding a multifilament thread includes a combined assembly 1, and an auxiliary roller 17 associated with combined assembly 1 a certain distance away therefrom. Combined assembly 1 is designed so that it performs within the godet unit the function of a godet 30 and the function of a mingling device 21. To this end, combined assembly 1 includes a guide jacket 2 that is attached in a rotationally fixed manner through a central connecting element 26 and a hub 5 to a drive shaft 6. Connecting element 26 and hub 5 are provided inside cylindrical guide jacket 2.

Multiple axially successive guide jacket guide sections 4.1 and 4.2 are provided around the circumference of guide jacket 2. A circumferential guide groove 7 is provided on a first guide section 4.1 that in this embodiment forms a right edge zone of guide jacket 2. In this embodiment, two nozzle orifices 8 offset by 180° are provided in guide groove 7. Nozzle orifices 8 penetrate guide jacket 2 up to its interior side. Inside guide jacket 2, a compressed-air supply device 9 projects from a drive side into the interior of guide jacket 2. Compressed-air supply device 9 in this embodiment is composed of a cylindrical stator 10 that has a bearing bore 24 at the center in which the drive shaft 6 is rotatably supported by multiple bearings 23. Inside guide jacket 2, stator 10 includes a guide collar 12 with an outer sliding surface 28 that is matched to the inner diameter of guide jacket 2. Stator 10 is stationary and is retained by a godet support 3.

The stator includes a pressure chamber 15 on a side opposite auxiliary roller 17, which chamber is connected through a compressed air connector 11 to a compressed air source, not shown here. In the region of guide collar 12, pressure chamber 15 includes a chamber orifice 16 that is disposed in a shared plane with circumferential guide groove 7. Chamber orifice 16 terminates in sliding surfaces 28, thereby allowing nozzle orifices 8 disposed in guide groove 7 to alternately move into the opening region of chamber orifice 16 as guide jacket 2 rotates. Chamber orifice 16 is provided radially in the form of an elongated hole, thereby allowing a predefined opening time interval to occur at nozzle orifice 8, during which a stream of compressed air exiting pressure chamber 15 passes in a pulsed fashion through nozzle orifice 8 into guide groove 7.

As seen in the illustration of FIG. 2, chamber orifice 16 is provided in the center region of a thread looping in which the thread is guided in contact with guide groove 7.

Located opposite to chamber orifice 16 in stator 10, a cover 13 is associated with guide groove 7 on guide section 4.1. Cover 13 is movably held by a swivel pin 14 on godet support 3, with the result that cover 13 can be moved away from guide groove 7 at the start of the process of threading in the thread.

Cover 13 extends radially over a partial region of guide groove 7, where cover 13 includes a sealing surface 31 matched to the circumference of guide groove 7, which sealing surface is disposed with a sealing gap 29 above guide section 4.1.

A second guide section 4.2 is directly associated on the circumference of guide jacket 2 in guide section 4.1. Second guide section 4.2 and first guide section 4.1 have identical outside diameters, with the result that guide groove 7 forms a depression around the circumference of guide section 4.1. Second guide section 4.2 extends over the entire region of guide jacket 2 up to a freely projecting end face. The length of guide section 4.2 is designed such that a thread 20 can be guided in multiple loopings together with auxiliary roller 17.

Drive shaft 6 in this embodiment is driven by an electric motor 19. When in operation, guide jacket 2 is driven at a predefined circumferential speed, thereby enabling a thread to be drawn off from an upstream treatment unit. In the embodiment illustrated in FIGS. 1 and 2, auxiliary roller 17 is disposed opposite guide jacket 2 so that the incoming thread 20 is first guided into guide groove 7 in guide section 4.1 of guide jacket 2. As a result, the incoming thread to the godet unit is first mingled whereby a pulse of compressed air is generated at intervals through nozzle orifices 8 within guide groove 7, thereby enabling a mingling or an interlacing of the thread to occur. The thread is subsequently taken up by auxiliary roller 17 and guide section 4.2 of guide jacket 2, and carried away in multiple loopings.

The embodiment illustrated in FIGS. 1 and 2 is thus especially well-suited to reproducibly creating interlacing knots generated by pressure pulses. The number of interlacing knots generated per thread length here can be easily increased by increasing the number of nozzle orifices 8 at the base of guide groove 7, thereby enabling a plurality of interlacing knots to be produced on the thread for each revolution of guide jacket 2.

In the embodiment illustrated in FIGS. 1 and 2, guide groove 7 provided on guide jacket 2 of combined assembly 1 to effect mingling is located in the region of an edge zone on the drive side, with the result that an incoming thread is mingled first.

Figure 3:
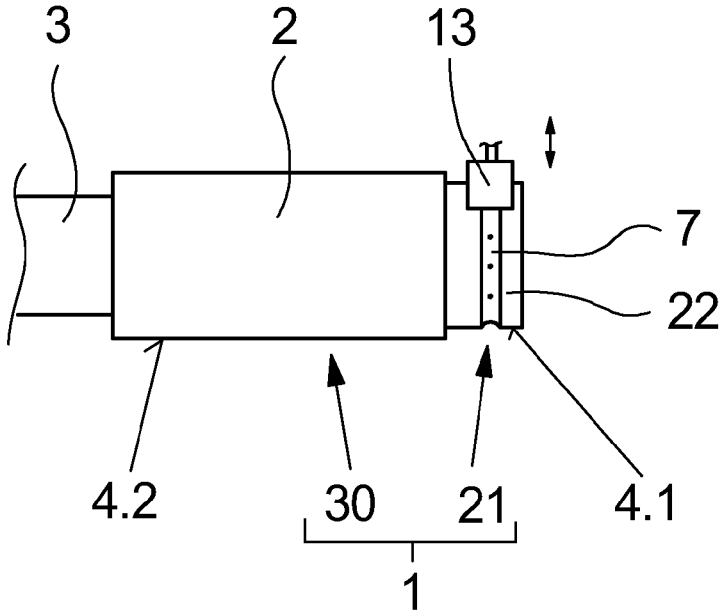
FIG. 3 is a schematic side view of another embodiment of a combined assembly for a godet unit based on the embodiment of FIG. 1.

Guide jacket 2 is illustrated in the embodiment of FIG. 3 in which guide sections 4.1 and 4.2 are designed in an axial sequence that is reversed. In this embodiment of a combined assembly, guide section 4.2 intended to guide the thread is provided on the drive side, while guide section 4.1 together with guide groove 7 is provided on the edge zone that is located at the free end face of guide jacket 2. In addition, guide section 4.2 is provided on a diameter stage 22. Diameter stage 22 in this case is smaller than the outside diameter of guide section 4.2. As a result, a relative speed is created between the thread guided around the circumference of guide section 4.2 versus guide section 4.1, with the result that slippage is created between guide groove 7 and thread 20. Relative speeds of this type have turned out to be advantageous in producing interlacing knots in such a way that especially stable interlacing knots were successfully generated.

Figure 4:
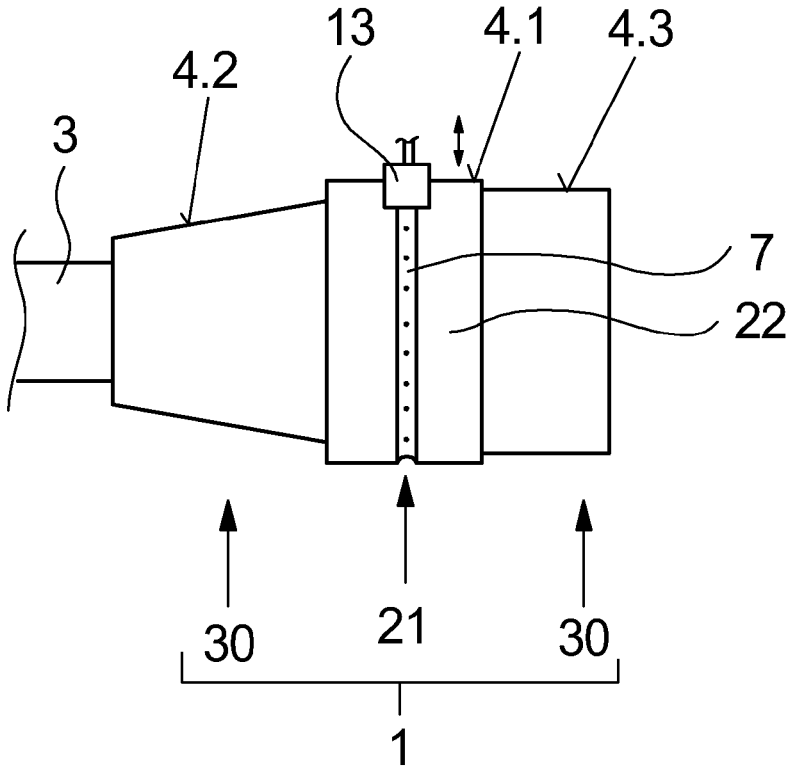
FIG. 4 schematically illustrates another embodiment of a combined assembly for use in the embodiment of FIG. 1.

In principle, however, it is also possible to provide guide groove 7 in a central guide section 4.1 that is disposed between a first guide section 4.2 and a third guide section 4.3. This embodiment is illustrated schematically in FIG. 4. Here the combined assembly includes a guide jacket 2 that is provided by a conical guide section 4.2, and two cylindrical guide sections 4.1 and 4.3. Center guide section 4.1 together with guide groove 7 in this embodiment is also provided on diameter stage 22, which is larger in diameter that the outside diameter of guide sections 4.2 and 4.3. Aside from relative speeds, this also allows additional changes in thread tension to be adjusted so as to obtain improved mingling along with the guidance.

Figure 5:
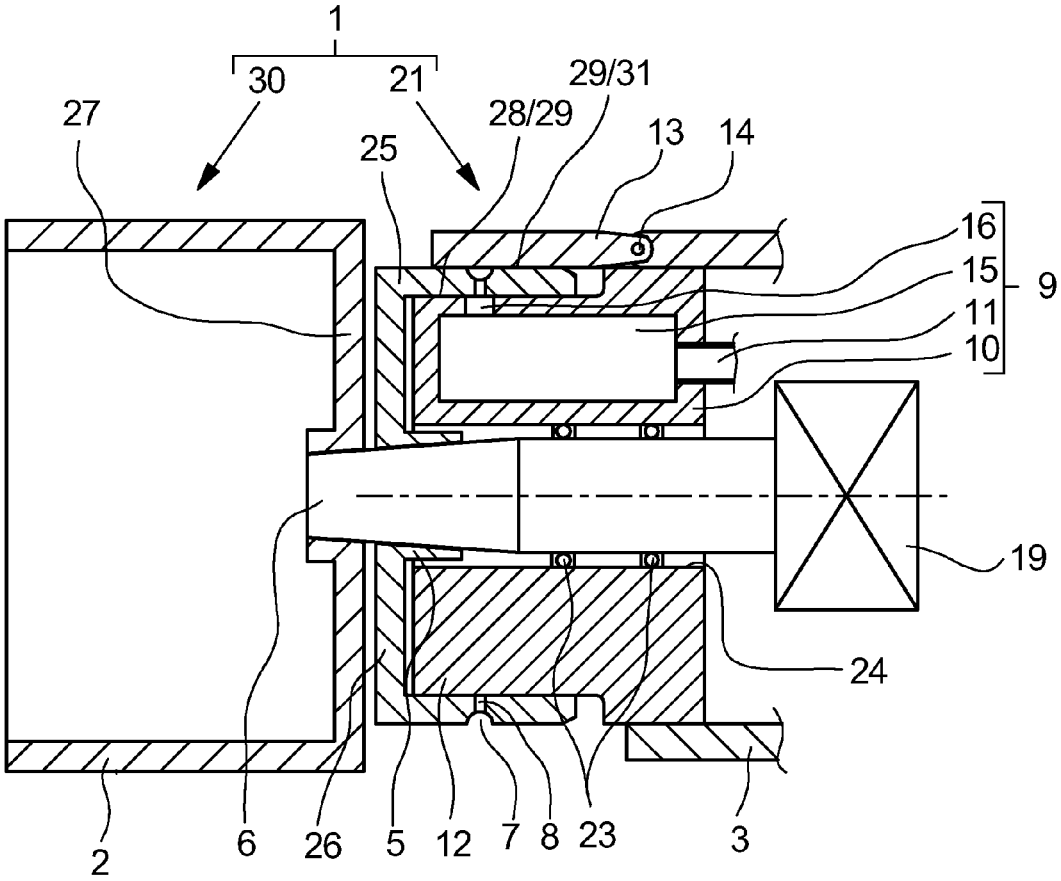
FIG. 5 is a schematic longitudinal view of another embodiment of the godet unit according to the invention.

The embodiment of the godet unit illustrated in FIGS. 1 and 2 is based on combined assembly 1, in which guide jacket 2 includes multiple guide sections. In principle, however, it is also possible to implement the guidance and the mingling of the thread by different means in the combined assembly. The embodiment of FIG. 5 thus reveals another variant of combined assembly 1 that could be used as an alternative to the embodiment illustrated in FIGS. 1 and 2. FIG. 5 provides a longitudinal cross-sectional view of combined assembly 1. Combined assembly 1 includes guide jacket 2 that is pot-shaped and is connected through an end wall 27 to a drive end of drive shaft 6. Guide jacket 2 has a cylindrical circumferential surface so as to be able to guide a thread with partial looping, and essentially forms a driven godet 30.

A nozzle ring 25 is disposed upstream in guide jacket 2, which ring is connected in rotationally fixed fashion through hub 5 to drive shaft 6. Nozzle ring 25 is also pot-shaped, the open side of nozzle ring 25 facing the drive side. Opposite this is guide jacket 2 with its open side facing away from the drive end.

Nozzle ring 25 has guide groove 7 around its circumference, which groove includes one or more nozzle orifices 8. Compressed-air supply device 9 is associated with nozzle ring 25, which device in this embodiment is of identical design to the embodiment of FIGS. 1 and 2. Thus, nozzle ring 25 is guided on guide collar 12 of stator 10, thereby allowing nozzle orifices 8 in guide groove 7 to alternately communicate with chamber orifice 16 on stator 10. Nozzle ring 25 and compressed-air supply device 9 thus essentially form mingling device 21.

Cover 13 is associated with nozzle ring 25 on the side opposite chamber orifice 16 of stator 10. Cover 13 in this embodiment is also identical to the above-referenced embodiment, and thus reference is made to the embodiment of FIGS. 1 and 2, and no additional explanation is provided here.

Drive shaft 6 is driven by an electric motor 19 in the embodiment of combined assembly 1 illustrated in FIG. 5. Drive shaft 6 is supported by bearings 23 in bearing bore 24 of stator 10. Here nozzle ring 25 and guide jacket 2 are driven synchronously. Nozzle ring 25 is of smaller diameter relative to guide jacket 2, with the result a smaller circumferential speed is produced on nozzle ring 25. Relative speeds and thread tensions can be determined based on the diameter differences, depending on whether an incoming thread or an outgoing thread is being mingled. However, it is also possbile for nozzle ring 25 to be of larger diameter than guide jacket 2.

Guide jacket 2 in this embodiment can be heated or unheated, with the result that the functions of a godet can be implemented so as to be detached from the mingling device. Within combined assembly 1, nozzle ring 25 performs the function of the mingling device that can thus be effected independently from the guidance of the thread on guide jacket 2.

The embodiments illustrated in the figures are only examples for combining the mingling device and the godet into one assembly. When using a nozzle ring, it is thus also possible to implement the ring using a separate drive, or also without a drive.

LIST OF REFERENCE NUMERALS

1 combined assembly
2 guide jacket
3 godet support
4.1, 4.2 guide section
5 hub
6 drive shaft
7 guide groove
8 nozzle orifice
9 compressed-air supply device
10 stator
11 compressed air connector
12 guide collar
13 cover
14 swivel pin
15 pressure chamber
16 chamber orifice
17 auxiliary roller
18 godet
19 electric motor
20 thread
21 interlacing device
22 diameter stage
23 bearing
24 bearing bore
25 nozzle ring
26 connecting element
27 end wall
28 sliding surface
29 gap
30 godet
31 sealing surface

The invention claimed is:

1. Godet unit for guiding a multifilament thread, comprising:

a driven godet, an auxiliary roller, or a second godet, from which the thread can be guided with multiple loopings, and a mingling device to air-mingle the thread, wherein the mingling device is integrated directly with the driven godet and forms a combined assembly performing the operation of the godet and the operation of the mingling device.

2. Godet unit according to claim 1, wherein the combined assembly includes a rotatingly driven guide jacket including multiple axially successive guide sections, wherein a circumferential guide groove is provided on one of the guide sections including at least one nozzle orifice penetrating the guide jacket, and wherein a compressed-air supply device is associated with the guide section inside the guide jacket.

3. Godet unit according to claim 2, wherein the guide section is provided with a guide groove on an edge zone of the guide jacket or in a central region of the guide jacket.

4. Godet unit according to claim 3, wherein the guide section is provided with the guide groove on a diameter stage of the guide jacket.

5. Godet unit according to claim 4, wherein the guide sections adjacent to the guide groove in terms of diameter are of identical size or unidentical size relative to the diameter stage.

6. Godet unit according to claim 5, wherein the guide sections of the guide jacket are of cylindrical or conical form.

7. Godet unit according to claim 1, wherein the combined assembly includes a rotatingly driven guide jacket and a rotating nozzle ring associated with the guide jacket, which nozzle ring has a circumferential guide groove on its circumference and at least one nozzle orifice terminating in the guide groove, and that the nozzle ring functions together with a compressed-air supply device disposed inside the nozzle ring.

8. Godet unit according to claim 7, wherein the guide jacket and the nozzle ring are connected to a drive shaft and are designed to be driven synchronously by an electrical drive means.

9. Godet unit according to claim 7, wherein the compressed-air supply device includes a stator with a pressure chamber and a chamber orifice, wherein the stator together with the chamber orifice is disposed on an interior side of the guide jacket or on an interior side of the nozzle ring opposite the guide groove.

10. Godet unit according to claim 9, wherein the stator includes a sliding surface in which the chamber orifice terminates and which forms a sealing gap against the inside of the guide jacket or inside of the nozzle ring.

11. Godet unit according to claim 10, wherein a stationary cover is associated with the guide groove on an exterior side opposite the stator, which cover extends radially over a partial region of the guide groove.

12. Godet unit according to claim 11, wherein the cover includes a sealing surface matched to the circumference of the guide groove, which surface is disposed with a sealing gap above the guide section or the nozzle ring.

13. Godet for use in a godet unit for guiding a multifilament thread, the godet comprising:

a rotatingly driven guide jacket, wherein the guide jacket includes multiple guide sections, wherein at least one of the guide sections includes a circumferential guide groove having at least one nozzle orifice in a groove base of the circumferential guide groove, wherein the godet unit includes (i) an auxiliary roller, or a second godet, from which the thread can be guided with multiple loopings, and (ii) a mingling device to air-mingle the thread, and wherein the mingling device of the godet unit is integrated directly with the godet and forms a combined assembly performing the operation of the godet and the operation of the mingling device.

* * * * *